US005257245A

United States Patent [19]

Thinesen

[11] Patent Number: 5,257,245

[45] Date of Patent: Oct. 26, 1993

[54] AUTOMATIC MODE SEQUENCING TO LAST USED MODE FOR MULTIMODE ELECTRONIC TIMEPIECE

[75] Inventor: Tom Thinesen, Sunnyvale, Calif.

[73] Assignee: Timex Corporation, Middlebury, Conn.

[21] Appl. No.: 22,206

[22] Filed: Feb. 25, 1993

[51] Int. Cl.[5] ..... G04C 17/00; G04B 19/00

[52] U.S. Cl. ..... 368/70; 368/187

[58] Field of Search ..... 368/69-70, 368/73, 74, 185-188, 82-84

[56] References Cited

U.S. PATENT DOCUMENTS 4,188,776 2/1980 Scherrer ..... 368/187
4,398,834 8/1983 Wakai ..... 368/223
4,989,188 1/1991 Thinesen ..... 368/70

*Primary Examiner*—Vit W. Miska
*Attorney, Agent, or Firm*—William C. Crutcher; Lise A. Rode

[57] ABSTRACT

Improvement in a multimode electronic timepiece having a display, a plurality of manually actuated actuators, including first and second actuators, and an integrated circuit programmed to keep time and to provide a current sequence of a plurality of modes for performing a plurality of timepiece functions, including at least first and second modes, said integrated circuit being programmed to permit an operator to sequentially cycle said timepiece through said plurality of modes, by selectively and repetitively actuating a first of said plurality of actuators, wherein said improvement comprises: first automatic mode selection means, including a program for said integrated circuit adapted to calculate at least first and second values respectively comprising the number of times the respective timepiece functions of said first and a second modes are performed by a timepiece operator in said current sequence, and to provide a next sequence of said plurality of modes, including said first and second modes of said current sequence, said second mode of said current sequence immediately preceding said first mode of said next sequence; and second automatic mode selection means, including a subroutine of said program being adapted to determine the order of said plurality of modes within said next sequence in response to said first and second values.

15 Claims, 5 Drawing Sheets

AUTOMATIC MODE SEQUENCING TO LAST USED MODE FOR MULTIMODE ELECTRONIC TIMEPIECE

This invention relates generally to multimode electronic timepieces. More particularly, this invention relates to an improved program for multimode electronic timepieces which is adapted to alter the predetermined sequence of modes of said timepiece in response to the use by a timepiece operator any of the functions of said modes.

Multimode, multifunction wristwatches (or wrist instruments) as known which include a display, a lamp for illuminating the display, a number of manually actuated switches and an integrated circuit programmed in a preselected sequence. Examples of such watches are seen in U.S. Pat. No. 4,788,733—Houlihan et al., U.S. Pat. No. 4,780,864—Houlihan and U.S. Pat. No. 4,283,784—Horan, all of the foregoing being assigned to the present assignee. In the Horan patent, a timepiece is provided with an integrated circuit, including a main random access memory (main RAM), a flag random access memory (flag RAM) and a programmed logic array (PLA), which are efficiently disposed in the timepiece such that a minimum amount of semiconductor chip space is used. The combination of these elements is adapted so as to provide for greater flexibility for operator selection of one of the plurality of timekeeping functions, or modes. In the foregoing Houlihan patents, which are merely exemplary of multimode electronic wrist instruments or multifunction wristwatches, one of the manual actuators may typically serve to repetitively cycle the instrument through a number of modes and operating states in each of which a different type of information is displayed. Such modes may include, in a multifunction watch, the time of day, chronograph, dual time zone countdown timer and so forth. By special preselected actuation of one of the actuators, the wristwatch may be converted into a computer, a speedometer, pulsometer or any other type of device, subject only to the imagination of the designer and programmer of the integrated circuit. While in any of these modes, another manual actuator may be employed to change the information being displayed in that mode's state, such as initiating the chronograph timing or setting the time-of-day, or performing a calculation.

A problem existing with multimode electronic timepieces adapted to provide a predetermined sequence of modes, is that as the number of modes of said timepiece increases, it becomes increasingly cumbersome for the timepiece operator to select a particular mode for use. Often the operator must cycle the timepiece through numerous intervening modes before disposing the timepiece into the mode which he desires to use. This is inconvenient and time-consuming for the timepiece operator.

Accordingly, one object of the present invention is to provide an improved program for a multimode electronic timepiece which is adaptable to the needs and uses of a timepiece operator.

Another object of the present invention is to assist the operator in the operation of the multimode electronic timepiece by providing the timepiece with an improved program which will automatically alter the sequence of the plurality of modes of said timepiece in response to the use by a timepiece operator of the functions of said modes.

A further object of the present invention is to provide an improved program for a multimode electronic timepiece which is adapted to automatically alter the sequence of the plurality of modes of said timepiece in response to the number of times the respective timepiece functions of said plurality of modes are performed by a timepiece operator.

SUMMARY OF THE INVENTION

Briefly stated, the invention comprises an improvement in a multimode electronic timepiece having a display, a plurality of manually actuated actuators, including first and second actuators, and an integrated circuit programmed to keep time and to provide a current sequence of a plurality of modes for performing a plurality of timepiece functions, including at least first and second modes, said integrated circuit being programmed to permit an operator to sequentially cycle said timepiece through said plurality of modes, by selectively and repetitively actuating actuating a first of said plurality of actuators, wherein said improvement comprises first automatic mode selection means, including a program for said integrated circuit adapted to calculate at least first and second values respectively comprising the number of times the respective timepiece functions of said first and second modes are performed by a timepiece operator in said current sequence, and to provide a next sequence of said plurality of modes, including said first and second modes of said current sequence, said second mode of said current sequence immediately preceding said first mode of said next sequence, and second automatic mode selection means, including a subroutine of said program being adapted to determine the order of said plurality of modes within said next sequence in response to said first and second values.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

DESCRIPTION OF THE PREFERRED EMBODIMENT

Figure 1:
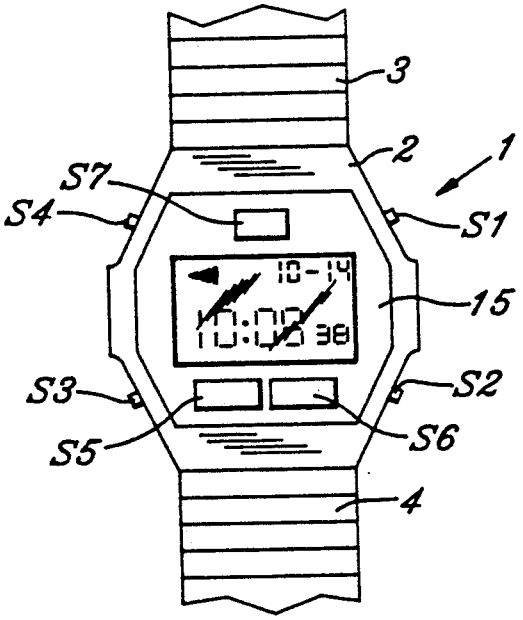
Prior Art Fig. 1
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes 7 manual push button actuators S1, S2, S3, S4, S5, S6, S7 arranged to close spring contacts (not shown), inside the watch case 2. An electrooptic display 15, which is commonly a liquid crystal display (or LCD) includes display fonts and displays digits, letters or other symbols when activated by a microcomputer inside the watch in the form of an integrated circuit.

Figure 2:
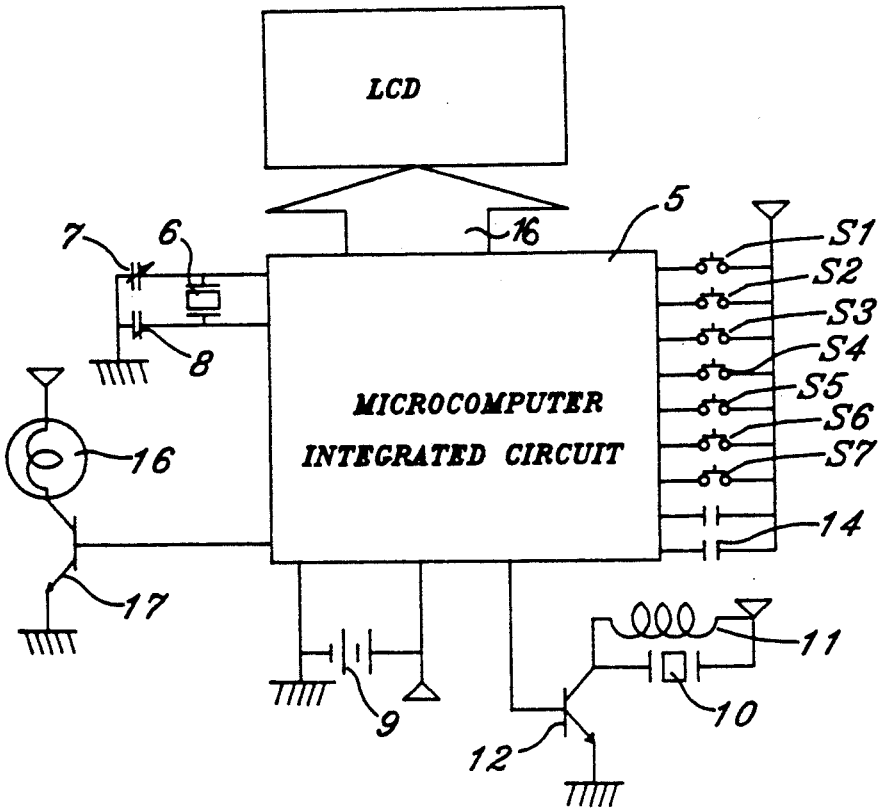
Prior Art Fig. 2
FIG. 2 is a block diagram of a circuit for the wristwatch of FIG. 1, together with external components such as lamp, switches and display.

Referring now to FIG. 2 of the drawing, a schematic block diagram of the electrical connection is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. The microcomputer includes a microprocessor (including a central processing unit, or CPU), operating system program for carrying out instructions, and memory locations. A quartz crystal 6 connected in circuit with capacitors 7 and 8 and connected to the oscillator pins of the integrated circuit 5 provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors, 13, 14 combined with other circuit elements combined inside the integrated circuit 5 serve to boost the output voltage to drive the LCD 15 through a display bus 16, which represents the several parallel leads connected to the various actuatable segments of the LCD display 15 (also shown in FIG. 1). Display 15 is arranged in close proximity with, so as to be illuminated by, a lamp 17 when the lamp is lit by a switching signal from integrated circuit 5 applied to the base of switching transistor 18.

Figure 3:
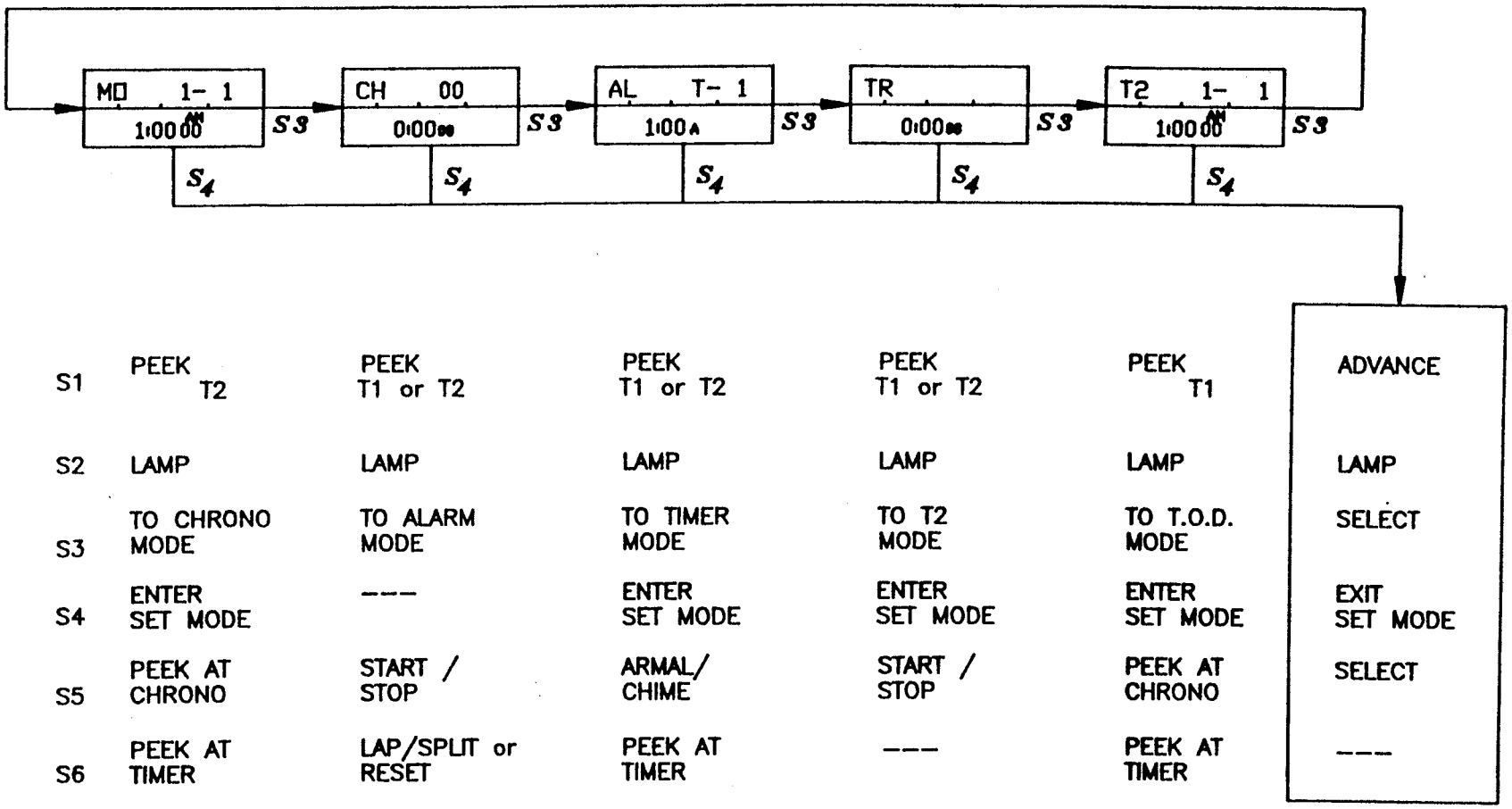
FIG. 3 is a block diagram of a multimode wristwatch illustrating a sequence of modes in response to manually actuated actuators.

Reference to FIG. 3 shows a block diagram of a multimode wristwatch and illustrates the sequence of modes in response to manual actuation switches S1–S7. Each of the blocks illustrates the initial appearance of the timepiece display at the moment the timepiece is first disposed into that particular mode. The modes for this particular timepiece are time-of-day, chronograph (CR), elapsed time (TR), alarm setting (AL), and alternate time zone (T2), although it will be understood that other modes may be substituted or added to said multimode wristwatch. Each mode may comprise a number of various states which in addition to any coincidental display on the timepiece electrooptic display are designated herein as "operating states."

As indicated in FIG. 3, the program is adapted such that repeated actuation of S3 sequentially cycles the timepiece through the aforementioned modes. Once the timepiece is disposed in one of the five modes, actuation of S4 initially initializes a subroutine SET for changing the information displayed, actuation of S3 or S5 selects the particular piece of information to be set (which is indicated on the display by "flashing" the indicia for that selected piece of information), actuation of S1 advances the said selected piece of information, and actuation of S2 cause the wristwatch lamp to be illuminated. Subsequent actuation of S4 while in the SET subroutine causes the timepiece to be disposed out of SET subroutine and returned to the home mode from which SET subroutine was entered.

Actuation of S5 while in time-of-day mode or alternate time zone mode will cause the chronograph mode to be temporarily displayed, said temporary display being coincident with the actuation of S5. Release of S5 will cause the timepiece to be respectively returned to the time-of-day or alternate time zone mode. Actuation of S5 while in the chronograph and timer modes will respectively initiate the chronograph and timer, while a second actuation of S5 will respectively stop the chronograph and timer. Repeated actuations of S5 while in these operating states will alternately start and stop the chronograph and timer. Finally, actuation of S5 while in the alarm setting mode will arm the alarm. If the timepiece operator actuates S6 when the timepiece is disposed in the time-of-day, alarm setting, and alternate time zone modes, the timer mode will be temporarily displayed, said temporary display being coincident with the actuation of S6. Release of S6 will cause the timepiece to be respectively returned to the time-of-day, alarm setting or alternate time zone modes. Repeated actuation of S6 while the timepiece is disposed in the chronograph mode and the chronograph is running will cause the timepiece to alternately display said chronograph readings in terms of "LAP" time (time elapsed since previous actuation of S6) and "SPLIT" time (cumulative time elapsed since first actuation of S6).

It is well known in the prior art to provide multimode timepieces with a predetermined sequence of modes, such that repetitive actuation of one of a plurality of actuators will eventually cycle the timepiece through said sequence of modes, and after which, continued repetitive actuation of said actuator will again cycle the timepiece through the same sequence of modes. In accordance with a preferred embodiment of the present invention, however, first automatic mode selection means, including a program of the timepiece integrated circuit, are adapted to determine for each mode, after a predetermined period of time, a value which represents the number of times any function of that particular mode is performed. Further, second automatic mode selection means, including a subroutine of the aforementioned program are adapted to provide a new sequence of modes, wherein the "position" of a particular mode within said new sequence, is determined by its respective value. Thus at predetermined time intervals, the sequential order of modes within the timepiece will change according to, and in direct response to, use of the timepiece mode functions by the timepiece operator.

Figure 4:
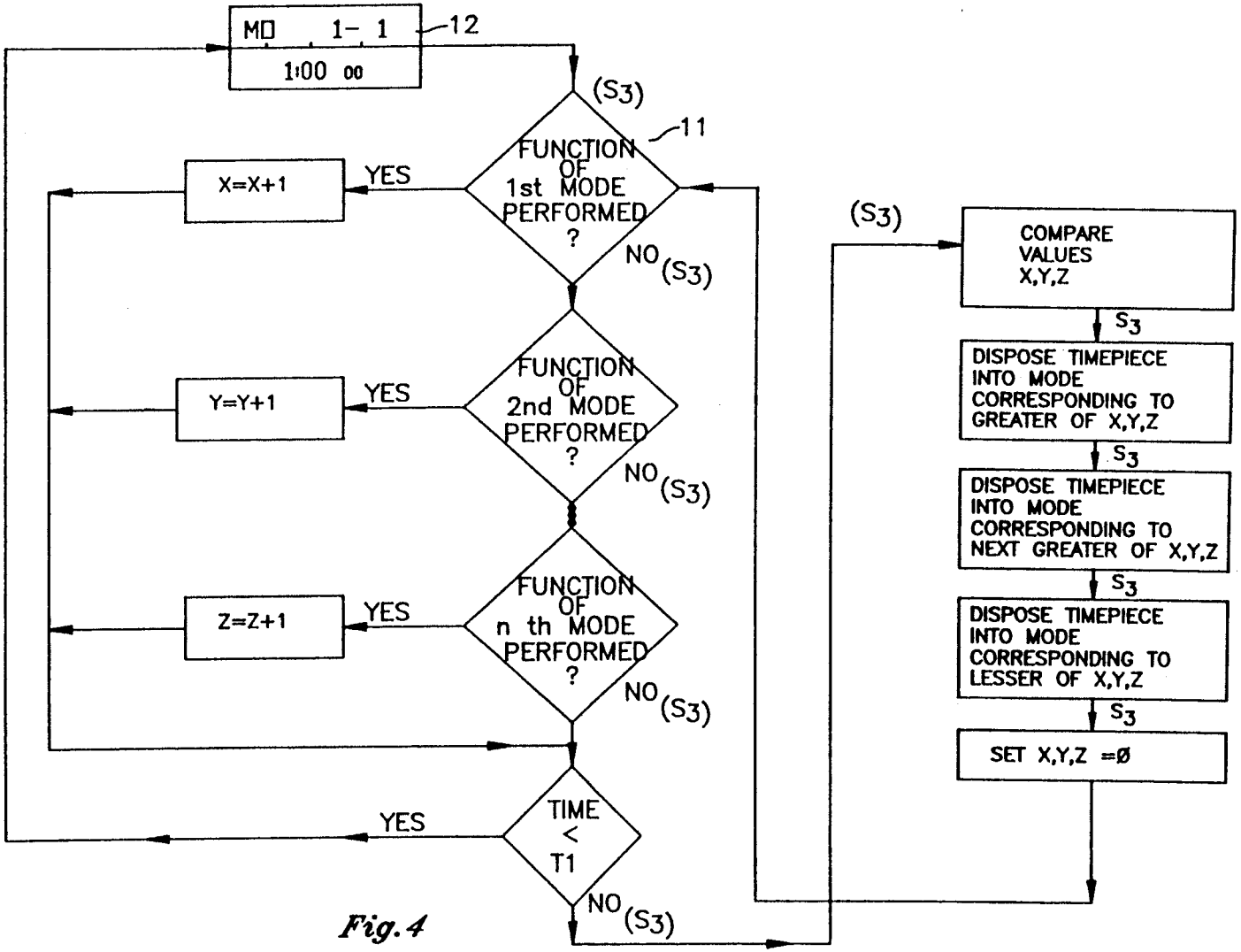
FIG. 4 is a flow chart for a preferred embodiment of the present invention, including a block diagram illustrating a new sequence of modes which occurs in response to the preferred embodiment of the present invention.

Reference to FIGS. 3 and 4 more clearly show the preferred embodiment of the present invention. As shown in the first decision state 11 of FIG. 4, when the timepiece is disposed into the first mode, the program queries whether a function of the first mode has been performed. If an affirmative is received, the program increments the value representing the number of times the timepiece function of that particular mode is performed (hereinafter, "mode function value"). Thus, in FIG. 4, "X", which represents said mode function value for the first mode, is incremented; this is shown in FIG. 4 as the decision state, "$X=X+1$". If, instead, a negative is received, said mode function value for the first mode is unaffected, and as shown in FIG. 4, upon actuation of S3 the program queries for the next mode whether its respective function has been performed, and then increments said mode's respective mode function value when appropriate.

In accordance with the preferred embodiment of the invention, once a mode function is performed, further actuation of S3 will dispose the timepiece back into the first mode, which as stated previously, is generally the time-of-day mode. However, if no mode function is performed, actuation of S3 will continue to dispose the timepiece into the immediately following mode, at which point the program continues to query for said immediately following mode, whether its respective function has been performed, and then increments said mode's respective mode function value when appropriate. The program repeatedly performs these instructions until a predetermined time has elapsed; T1 in FIG. 4. (T1 is determined by timing means not shown).

Referring to the right hand side of FIG. 4, after time T1 has elapsed, second automatic mode selection means including a subroutine of the aforementioned program are adapted to determine the order of the modes according to descending mode function values; i.e., the mode whose mode function value is the greatest will be the first mode in the new sequence, and the mode whose mode function value is the least, will be the last mode in the new sequence. Thus, after the elapse of time T1, when the timepiece operator repetitively actuates S3, the timepiece will be cycled through a new sequential order of modes as determined by the subroutine. (Each mode function value may be stored as a separate count in timepiece counter means, which the subroutine may then address in determining the order of the modes in the new sequence. However, it will be understood that the instant invention may be extended to include similar such register means and/or comparator means as is known in the art.)

Once the order of the modes of the new sequence has been determined, the subroutine sets each mode function value to zero. (FIG. 4). Repeated actuation of S3 will cycle the timepiece through this new sequential order of modes. During this time, the program will again keep track of the number of times each mode's function is performed by the operator, and will increment its mode function value as discussed above.

As an example of the preferred embodiment of this invention, reference is made to FIG. 3. Before the elapse of predetermined time T1, the timepiece operator: 1) actuates S3 to dispose the timepiece into the chronograph mode; 2) starts/stops the chronograph (S5); 3) exits the chronograph mode (thus returning the timepiece to the first mode); 4) cycles the timepiece to the alternate time zone mode (S3); 5) sets the alternate time zone time (S4); 6) exits the alternate time zone time mode (again returning the timepiece to the first mode); 7) cycles the timepiece back to the chronograph mode (S3); and, finally 8) starts/stops the chronograph again (S5). Time T1 then expires. Before the elapse of T1, a function of the chronograph was performed two times, and a function of the alternate time zone time was performed once. No other mode function was performed by the timepiece operator prior to the elapse of T1. Therefore, upon further actuation of S3, the timepiece will cycle through the remaining modes of the first sequence (i.e., the alarm, timer and alternate time zone time modes), after which continued actuation of S3 will cycle the timepiece through a new sequence of modes beginning with the chronograph mode and followed directly by the alternate time zone time, time-of-day, alarm and timer modes.

Another feature of the instant invention is that if the timepiece operator disposes the timepiece into a mode but does not perform any of the functions of that particular mode, its mode function value will not be affected, and therefore its relative position in the new sequence of modes will be unaffected. In the above example, if the timepiece operator had actuated S4 and thus entered the "SET" operating state for the alternate time zone mode (FIG. 3), but exited that operating state without actually setting the time, the mode function value for the alternate time zone mode would not be affected. Thus, in the above example, after the elapse of time T1, the relative position of the alternate time zone mode in the new sequence of modes would be unchanged, and the new sequence of modes would be as follows: chronograph mode, time-of-day mode, alarm mode, timer mode, and alternate time zone mode.

It will also be appreciated from the above discussion that, under the preferred embodiment of this invention, the program can thus provide as many as n! different sequences of modes, where "n" represents the number of modes of the timepiece.

Alternate Embodiment

In general the first mode in most multimode timepieces is the time-of-day mode, which is also the mode most used by the timepiece operator. A timepiece operator may thus desire the first mode of his timepiece to always be the time-of-day mode, and that only the subsequent modes of the sequence be altered to accommodate his usage patterns. (Although preferably the first mode of a timepiece sequence of modes is the time-of-day mode, it will be understood that the following discussion is intended to include timepieces wherein the first mode comprises a mode other than the time-of-day mode).

Therefore in accordance with an alternate embodiment of the present invention, first automatic mode selection means including a program of the timepiece integrated circuit are adapted to determine which mode after the first mode of the timepiece was the mode for which a function was last performed before the elapse of time T1. Further in accordance with the alternate embodiment of the invention, second automatic mode selection means, including a subroutine of said program are adapted to provide a new sequential order of modes, wherein the second mode of the new sequence comprises that mode for which a function was last performed by the timepiece operator before the elapse of T1.

Figure 5:
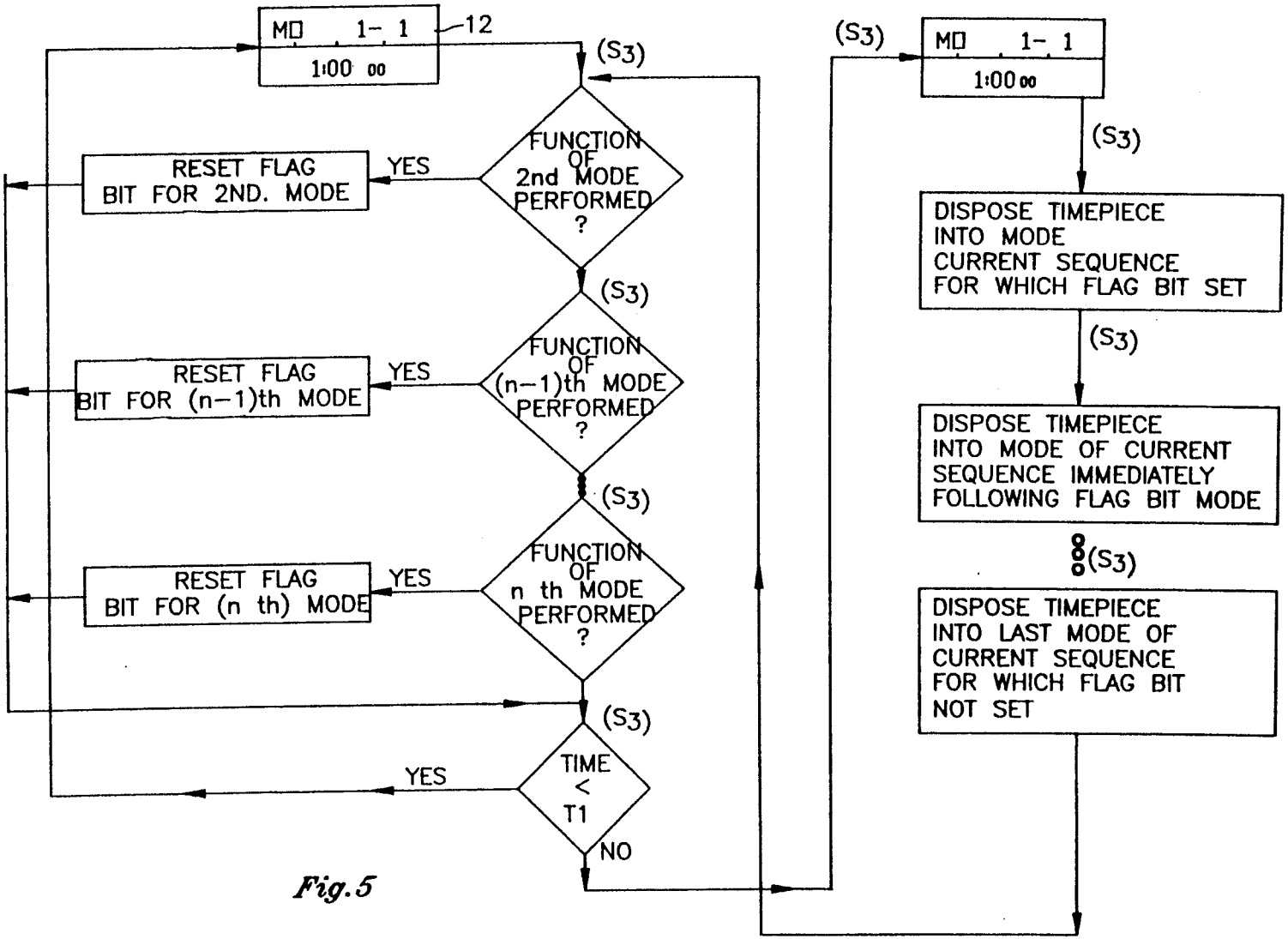
FIG. 5 is a flow chart for an alternate embodiment of the present invention, including a block diagram illustrating a new sequence of modes which occurs in response to the alternate embodiment of the present invention.

An example of this alternate embodiment is more readily apparent from reference to FIG. 5. The rectangle 12 at the top of FIG. 5, represents the time-of-day mode. Actuation of S3 will dispose the timepiece into the next mode (not shown) of the first sequence of modes at which time the integrated circuit program will query for the second mode whether the function of this mode has been performed (FIG. 5). If an affirmative is received by the program, a flag bit will be set for the second mode, and in the preferred embodiment of the invention, the timepiece will be returned to the first mode, which, as stated previously, is generally the time-of-day mode. However, if a negative is received, the program will query for the third mode of the first sequence, whether its function has been performed. If an affirmative is received for the third mode, a flag bit will be reset for the third mode, and again the timepiece will be returned to the first mode. The program repeatedly performs these instructions until a predetermined time has elapsed; T1 in FIG. 5.

As further shown in FIG. 5, after time T1 has elapsed, second automatic mode selection means, including a subroutine of the aforementioned program are adapted to determine as the second mode in the new sequence, that mode of the first sequence which was the last mode for which a flag bit was set; the order of the remaining modes in the new sequence are in the same relative order as they were in the first sequence. (As with the previous embodiment of this invention, each mode function value may be stored as a separate count in timepiece counter means, which the subroutine may then address in determining the order of the modes in the new sequence. However, it will be understood that the instant invention may be extended to include similar such register means and/or comparator means as is known in the art.)

Repeated actuation of S3 will cycle the timepiece through this new sequential order of modes. During this time, the program will again set a flag bit for a mode every time a function of that mode is performed.

Thus, for example, under said alternate embodiment, the timepiece operator cycles the timepiece through the plurality of modes, but the only function he performs before the elapse of time T1 is to set the timer (See, FIG. 3). Time T1 then elapses. Upon further actuation of S3, the timepiece will cycle through the remaining modes of the first sequence (i.e., in FIG. 3 the alternate time zone time mode), after which continued actuation of S3 will cycle the timepiece through a new sequence of modes beginning with the time-of-day mode and followed directly by the timer, chronograph, alarm and alternate time zone time modes.

As with the preferred embodiment, if no function of any of the plurality of modes is performed, no flag bit is set and the order of the modes in the new sequential order will remain unchanged. If in the above example the timepiece operator had entered the set mode for timer mode (FIG. 3), but had the operator actually not set the timer, the flag bit would not have been set for the timer mode. Thus, after the elapse of time T1, the sequence of modes would be unchanged; i.e., time-of-day mode, chronograph mode, alarm mode, timer mode, and alternate time zone mode.

It will also be appreciated from the above discussion that, under the alternate embodiment of this invention, the program can thus provide as many as $(n-1)!$ different sequences of modes, where "n" represents the number of modes of the timepiece.

Return to Last Exited Operating State

Figure 6:
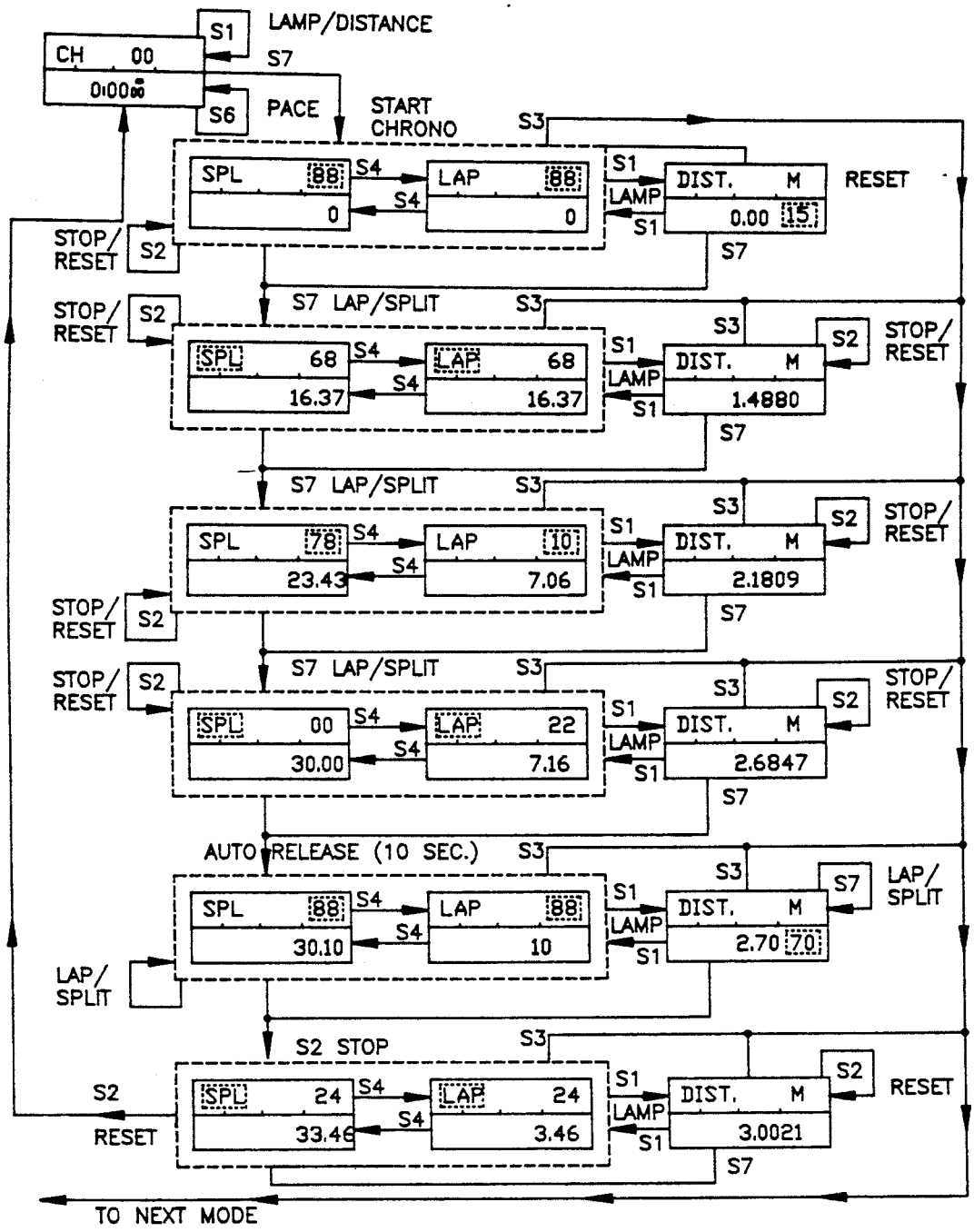
FIG. 6 is a detailed state diagram illustrating the sequence of the operating states of the chronograph mode of a multimode wristwatch.

Reference to FIG. 6 illustrates the detailed state diagram for a chronograph mode of a multimode wristwatch. The integrated circuit is programmed to place the timepiece into the first operating state of the chronograph mode upon actuation of a manual actuator S7 while the timepiece is disposed in the chronograph mode (FIG. 3). This single actuation of actuator S7 will initiate the chronograph subroutine and will cause the display to increment every hundredth of a second. Repetitive actuation of S7 will display the elapsed time since the last closure of S7, either in lap time (time elapsed since previous switch closure) or in split time (cumulatively time elapsed since first switch closure).

A single actuation of S2 while the chronograph is incrementing but before actuation of S7 will stop the chronograph, and a second actuation of S2 will reset the timepiece and dispose the timepiece into the chronograph/countdown timer mode. If however, the operator actuates S2 after actuation of S7, the chronograph will also stop, but a second closure of S2 at this point will cause the display to show the elapsed time between the current and previous closures of S2. A third actuation of S2 will then reset the timepiece to the chronograph/countdown timer mode.

Repetitive actuation of actuator S4 will cause the timepiece to be alternately disposed in the split time and lap time operating states. The split time operating state, provides the cumulative time that has elapsed since first actuation of the chronograph, and for purposes of this discussion, is the "home" or first operating state of the chronograph mode. The lap time operating state provides the time that has elapsed between consecutive closings of actuator S4, and for purposes of this discussion, is the next operating state following the "home" operating state of the chronograph mode. A single actuation of actuator S1 from either split time or lap time will concurrently illuminate the timepiece's lamp (not shown) and dispose the timepiece into the distance operating state of the chronograph mode. A second actuation of S1 will dispose the timepiece back into either the lap time operating state or the split time operating state. The integrated circuit is also adapted to provide for an automatic return to the chronograph/countdown timer mode after the elapse of ten seconds.

In accordance with both embodiments of the instant invention, if the timepiece operator disposes the timepiece into a mode which comprises a plurality of operating states (e.g., the chronograph mode, FIG. 6) and then directly exists that mode from said operating state without performing any function of that particular mode before the elapse of T1, the timepiece will always automatically be disposed into that particular operating state when the timepiece is cycled back to that respective mode. Thus if the timepiece operator disposes the timepiece into, for example, the chronograph mode, actuates S4 to enter the "LAP" operating state, and then immediately actuates S3 to exit the chronograph mode, and does not start the chronograph at any time before the elapse of T1, the timepiece will automatically be disposed in the "LAP" operating state the next time after the elapse of T1 that the timepiece is cycled through to the chronograph mode.

The term "mode" is used herein to designate the basic operating modes of a multimode electronic timepiece.

The term "operating state" is used herein to designate the various states which are included in any mode of the timepiece's plurality of modes, as well as any coincidental display of that function's value on the timepiece's electrooptic display 15.

The term "home operating state" is used herein to designate the first operating state of a mode's plurality of operating states into which a timepiece is initially disposed as it is cycled through said plurality of operating states.

The term "next operating state" is used herein to designate the operating state following the home operating state.

The term "current sequence" is used herein to designate the sequence of modes of the timepiece before the elapse of a predetermined time interval (T1 above);

The term "next sequence" is used herein to designate the sequence of modes of the timepiece after the elapse of a predetermined time interval (T1 above);

While there has been described what is considered to be the preferred and alternate embodiments of the invention, other modifications will become known to those skilled in the art, and it is desired to cover, in the appended claims, all such modifications as fall within the true spirit of the scope of the invention.

What is claimed is:

1. Improvement in a multimode electronic timepiece having a display, a plurality of manually actuated actuators, including first and second actuators, and an integrated circuit programmed to keep time and to provide a current sequence of a plurality of modes for performing a plurality of timepiece functions, including at least first and second modes, said integrated circuit being programmed to permit an operator to sequentially cycle said timepiece through said plurality of modes, by selectively and repetitively actuating a first of said plurality of actuators, wherein said improvement comprises:

first automatic mode selection means, including a program for said integrated circuit adapted to provide at least first and second values respectively comprising the number of times the respective timepiece functions of said first and second modes are performed by a timepiece operator in said current sequence, and to provide a next sequence of said plurality of modes, including said first and second modes of said current sequence;

second automatic mode selection means, including a subroutine of said program adapted to determine the order of said plurality of modes within said next sequence in response to said first and second values.

2. Improvement in a multimode electronic timepiece having a display, a plurality of manually actuated actuators, including first and second actuators, and an integrated circuit programmed to keep time and to provide a current sequence of a plurality of modes for performing a plurality of timepiece functions, including at least first, second and third modes, said integrated circuit being programmed to permit an operator to sequentially cycle said timepiece through said plurality of modes of said current sequence by selectively and repetitively actuating a first of said plurality of said actuators, wherein said improvement comprises:

first automatic mode selection means, including a program for said integrated circuit adapted to provide a next sequence of said plurality of modes, including said first, second and third modes of said current sequence;

flag means, including a flag bit for said plurality of timepiece modes, second automatic mode selection means, including a subroutine of said program adapted to set the flag bit for the one of said plurality of modes of said current sequence which most proximately precedes the first mode of said next sequence, and for which a timepiece function was performed, and further adapted to determine as the second mode of said next sequence that mode of the current sequence for which the flag bit is set.

3. Improvement in a multimode electronic timepiece having a display, a plurality of manually actuated actuators, including first and second actuators, and an integrated circuit programmed to keep time and to provide a current sequence of a plurality of modes for performing a plurality of timepiece functions, including at least first and second modes, said integrated circuit being programmed to permit an operator to sequentially cycle said timepiece through said plurality of modes, by selectively and repetitively actuating a first of said plurality of actuators, wherein said improvement comprises:

first automatic mode selection means, including a program for said integrated circuit adapted to provide at least first and second values respectively comprising the number of times the respective timepiece functions of said first and second modes are performed by a timepiece operator in said current sequence, and to provide at least a next sequence of said plurality of modes, including said first and second modes, said second mode of said current sequence immediately preceding said first mode of said next sequence;

counter means for providing for said first and second values, respectively, a first and second count, second automatic mode selection means, including a subroutine of said program adapted to determine the order of said plurality of modes within said next sequence in response to said first and second count in the counter means.

4. The improvement according to claim 3, wherein said first and second modes of said next sequence respectively comprise the modes corresponding to the greater and lesser of said first and second count of said counter means.

5. Improvement in a multimode electronic timepiece having a display, a plurality of manually actuated actuators and an integrated circuit programmed to keep time and to provide a current sequence of a plurality of modes for performing a plurality of timepiece functions, including at least first and second mode, said integrated circuit being programmed to permit an operator to sequentially cycle said timepiece through said plurality of modes, by selectively and repetitively actuating a first of said plurality of said actuators, wherein said improvement comprises:

first automatic mode selection means, including a program for said integrated circuit adapted to provide at least first and second values respectively comprising the number of times the respective timepiece functions of said first and second modes are performed by a timepiece operator in said current sequence, and to provide at least a next sequence of said plurality of modes, including said first and second modes, said second mode of said current sequence immediately preceding said first mode of said next sequence;

counter means for providing for said first and second values, respectively, at least first and second counts, comparator means for comparing said first and second counts, and for providing an output, second automatic mode selection means, including a subroutine of said program adapted to determine the order of said plurality of modes within said next sequence in response to said output of said comparator means.

6. The improvement according to claim 5, wherein said comparator means output comprises the greater of said first and second counts of said counter means.

7. The improvement according to claim 1, wherein said first and second modes of said next sequence respectively comprise said first and second modes of said current sequence if no timepiece function of said first and second modes of said current sequence is performed.

8. The improvement according to claim 2, wherein said first, second and third modes of said next sequence respectively comprise said first, second and third modes of said current sequence if no timepiece function of said first, second and third modes of said current sequence is performed.

9. The improvement according to claim 1, wherein said program is further adapted to provide said first and second values at predetermined intervals of time.

10. The improvement according to claim 2, wherein said program is further adapted to provide said first and second values at predetermined intervals of time.

11. The improvement according to claim 2, wherein said program is adapted to set said flag bit at predetermined intervals of time.

12. The improvement according to claim 7, wherein at least one of said first and second modes further includes a plurality of operating states, including at least home and next operating states, and wherein said home operating state of said second mode of said next sequence comprises said next operating state of said second mode of said current sequence, if said second actuator is actuated while the timepiece is disposed in said second mode during said current sequence.

13. The improvement according to claim 8, wherein at least one of said first, second and third modes includes a plurality of operating states, including at least home and next operating states, and wherein said home operating state of said second mode of said next sequence comprises said next operating state of said second mode of said current sequence, if said second actuator is actuated while the timepiece is disposed in said second mode during said current sequence.

14. The improvement according to claim 1, wherein said program is adapted to provide a plurality of sequences, said plurality being represented by the equation, n!, wherein n represents the number of modes of said timepiece.

15. The improvement according to claim 2, wherein said program is adapted to provide a plurality of sequences, said plurality being represented by the equation, $(n-1)!$, wherein n represents the number of modes of said timepiece.

* * * * *